US006322290B1

(12) United States Patent
Calandra, Jr. et al.

(10) Patent No.: US 6,322,290 B1
(45) Date of Patent: Nov. 27, 2001

(54) CABLE BOLT HEAD

(75) Inventors: Frank Calandra, Jr.; Eugene H. Stewart, both of Pittsburgh; Stanley Ponce, Cresson; John G. Oldsen, Butler; John C. Stankus, Canonsburg, all of PA (US); Brian R. Castle, Rolla, MO (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 09/490,344

(22) Filed: Jan. 24, 2000

Related U.S. Application Data

(62) Division of application No. 08/585,319, filed on Jan. 11, 1996, now Pat. No. 6,056,482.

(51) Int. Cl.[7] ..... E02D 17/00; E21D 20/00
(52) U.S. Cl. ..... 405/259.1; 405/302.2
(58) Field of Search ..... 405/259.1, 302.2, 405/259.4; 52/223.13; 403/374.1; 411/44

(56) References Cited

U.S. PATENT DOCUMENTS

| | | | | |
|---|---|---|---|---|
| 3,077,809 | | 2/1963 | Harding et al. | 85/2.4 |
| 3,137,971 | * | 6/1964 | Rhodes | 405/259.1 |
| 3,226,934 | | 1/1966 | Emery | 61/45 |
| 3,394,527 | | 7/1968 | McLean | 52/741 |
| 3,507,121 | | 4/1970 | Morfeldt | 61/39 |
| 3,971,177 | | 7/1976 | Endo | 52/166 |
| 4,247,225 | | 1/1981 | Chickini, Jr. et al. | 405/260 |
| 4,265,571 | | 5/1981 | Scott | 405/259 |
| 4,378,180 | | 3/1983 | Scott | 405/259 |
| 4,472,088 | | 9/1984 | Martin | 405/259 |
| 4,531,861 | | 7/1985 | Kash | 405/261 |
| 4,784,531 | | 11/1988 | Calandra, Jr. | 405/261 |
| 4,798,501 | * | 1/1989 | Spies | 405/260 |
| 4,832,534 | | 5/1989 | Duvieusart | 405/261 |
| 4,866,903 | | 9/1989 | Ferstay | 52/677 |
| 4,896,416 | | 1/1990 | Cranko et al. | 29/522.1 |
| 5,072,558 | * | 12/1991 | Sorkin et al. | 52/230 |
| 5,113,634 | | 5/1992 | Lüthi | 52/741 |
| 5,230,589 | * | 7/1993 | Gillespie | 405/259.6 |
| 5,253,960 | * | 10/1993 | Scott | 405/302.2 |
| 5,259,703 | * | 11/1993 | Gillespie | 405/259.6 |
| 5,288,176 | | 2/1994 | Huff et al. | 405/259.6 |
| 5,375,946 | * | 12/1994 | Locotos | 405/259.4 |
| 5,378,087 | | 1/1995 | Locotos | 405/259.5 |
| 5,415,498 | | 5/1995 | Seegmiller | 405/288 |
| 5,417,521 | | 5/1995 | Scott | 405/259.6 |
| 5,462,391 | | 10/1995 | Castle et al. | 405/302.2 |
| 5,466,095 | | 11/1995 | Scott | 405/302.2 |
| 5,511,909 | * | 4/1996 | Calandra, Jr. et al. | 405/259.6 |
| 5,570,976 | * | 11/1996 | Fuller et al. | 405/302.2 |
| 5,586,839 | | 12/1996 | Gillespie | 405/259.1 |
| 5,586,939 | * | 12/1996 | Gillespie | 405/259.1 |
| 5,802,788 | * | 9/1998 | Ozawa et al. | 52/223.13 |
| 5,829,922 | | 11/1998 | Calandra, Jr. et al. | 405/302.2 |

FOREIGN PATENT DOCUMENTS

| | | |
|---|---|---|
| 1059351 | 7/1979 | (CA) . |
| 3435117 | 4/1985 | (DE) . |
| WO93/03256 | 2/1993 | (WO) . |

OTHER PUBLICATIONS

Dywidag Systems International, USA, Inc.; Dywidag Passive Cable Bolt publication; Feb. 1994; 1 sheet.
Stephen C. Tadolini and Jamie L. Gallagher; *Cable Bolts for Longwall Gate Entry Support*; pp. 77–89.

* cited by examiner

*Primary Examiner*—Thomas B. Will
*Assistant Examiner*—Gary S. Hartmann
(74) *Attorney, Agent, or Firm*—Webb Ziesenheim Logsdon Orkin & Hanson, P.C.

(57) ABSTRACT

A mine roof bolt includes a flexible multi-strand cable having a first and second end with a drive head formed on the first head, the drive head having a plurality of driving faces on an exterior surface thereof. A load bearing barrel and wedge assembly is attached to the cable, with a separate drive head attached to the cable, wherein the separate drive head is utilized substantially for rotating the cable.

15 Claims, 1 Drawing Sheet

CABLE BOLT HEAD

This application is a divisional of U.S. patent application Ser. No. 08/585,319 entitled "Cable Bolt Head" filed Jan. 11, 1996, now U.S. Pat. No. 6,056,482. This Application is also related to U.S. patent application Ser. No. 08/652,791, entitled "Cable Bolt Head", filed May 23, 1996, now U.S. Pat. No. 5,829,922.

BACKGROUND OF THE INVENTION

1. Field of the Invention

The present invention relates to mine roof bolts. Specifically, the present invention relates to flexible mine roof bolts utilizing a multi-strand cable and which are adapted to be rotated in the bore hole by a drive head at a first end thereof.

2. Description of the Prior Art

Flexible cable bolts and cable systems have been utilized in the construction and mining industries since about 1970. More recently, cable mine roof bolts have been utilized as a roof control in the mining industry with both resin grouting and more conventional cement grouting techniques. Examples of cable mine roof bolts, utilized in resin grouting applications, can be found in U.S. Pat. No. 5,230,589 to Gillespie; U.S. Pat. No. 5,259,703 to Gillespie; U.S. Pat. No. 5,375,946 to Locotos; and WIPO Publication No. WO 93/03256 to Fuller et al. All of these mine roof bolt designs incorporate some type of drive head assembly for rotating the cable bolt. All of these prior art systems suffer from various drawbacks.

The mine roof bolt, disclosed in the Gillespie patents, replaces a tubular barrel of a conventional barrel and wedge assembly with a specially machined hexagonal head collar. The hexagonal head collar must necessarily be large enough to receive the internal wedges therein, which make the head collar too large to be driven with conventional bolting equipment. Consequently, in addition to the special machining of the hexagonal drive head, the Gillespie patents require the use of specialized adapters by the bolting equipment to accommodate the enlarged hexagonal head.

WIPO Publication No. WO 93/03256 and the Locotos patent disclose cable mine roof bolts which utilize a hex nut attached to the end thereof, to both rotate the cable bolt and support the bearing plate. The WIPO publication discloses inclusions of threads on at least one of the strands of the cable so that the hex nut can be threaded directly onto the cable. The Locotos patent utilizes a collar having a threaded end which is attached to the cable with the hex head threaded onto the collar. These designs require the attachment of the hex nut to the cable to meet the loading capacity of the cable bolt since the drive heads also serve to support the bearing plate.

It is the object of the present invention to provide a mine roof bolt design which overcomes the disadvantages of the above-described prior art. It is a further object of the present invention to provide a mine roof bolt design which can be utilized with conventional roof bolting equipment. A further object of the present invention is to provide a mine roof bolt which is easy and economical to manufacture.

The objects of the present invention are achieved by an embodiment of the present invention that provides a mine roof bolt which includes a flexible multi-strand cable, a barrel and wedge assembly attached to the cable between first and second ends thereof, and a drive head attached to the multi-strand cable at a position spaced along the cable from the barrel and wedge assembly, with the drive head having a plurality of driving faces on an exterior surface thereof.

In this embodiment, the drive head may be positioned adjacent to the barrel and wedge assembly, wherein the drive head extends less than one inch beyond the barrel and wedge assembly. Alternatively, the mine roof bolt of this embodiment may further include a sleeve member surrounding the cable which is formed integrally with the drive head. The sleeve member may be positioned to extend partially into the barrel of the barrel and wedge assembly. The sleeve member may be attached to the cable by swaging, adhesives, welding or combinations thereof. Additionally, the drive head may include a central bore therethrough for receiving the cable. The drive head may be secured to the cable by use of adhesives, a cable-spreading wedge or a combination thereof. A cable-spreading wedge may be inserted into a first end of the cable which is received within the bore of the drive head. The cable-spreading wedge will bias the outer strands of the cable against the drive head to secure the cable to the drive head.

These and other advantages of the present invention will be clarified in the brief description of the preferred embodiments, wherein like reference numerals represent like elements throughout.

BRIEF DESCRIPTION OF THE PREFERRED EMBODIMENTS

Figure 1:
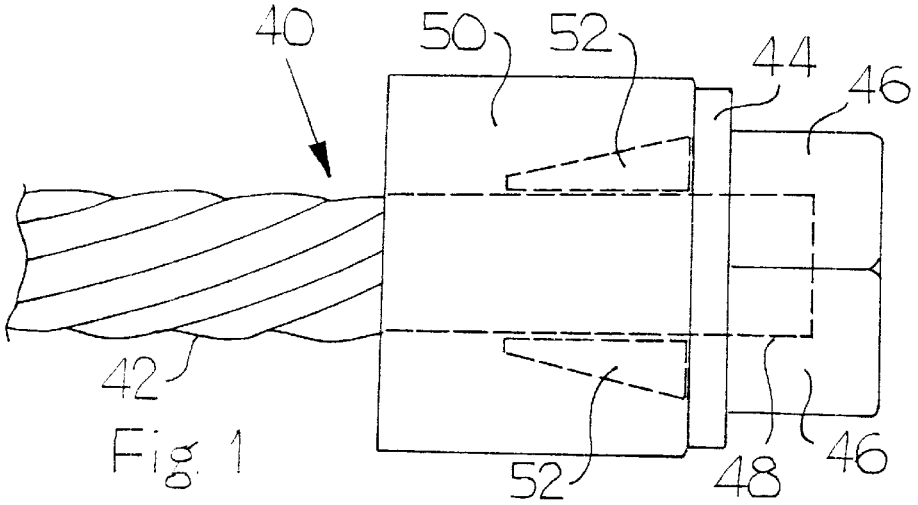
FIG. 1 is a side view of a cable mine roof bolt according to one embodiment of the present invention.

FIG. 1 illustrates a cable mine roof bolt 40 according to the present invention. The mine roof bolt 40 includes a central cable 42 which is adapted to be received into a bore hole. The cable 42 is preferably standard seven-wire cable which is described in ASTM designation A 416 entitled "Standard Specification for Steel Strand, Uncoated Seven-Wire for Presetressed Concrete". The cable 42 is preferably a seven-strand type, which has a center strand enclosed tightly by six helically wound outer strands with a uniform pitch of between twelve and sixteen times the nominal diameter of the cable. The cable 42 generally comes in grades determined by the minimum ultimate strength of the cable. For example, Grade 250 has a minimum ultimate strength of 250,000 psi and Grade 270 has a minimum ultimate strength of 270,000 psi. Additionally, bird cages may be incorporated into the length of the cable 42 at selected positions thereon. Similarly, buttons can be swaged onto the cable 42 at spaced positions thereon. The bird cages and buttons help improve the mixing of the resin as well as increase the bond strength of the attachment as is known in the art.

At a first end of the cable 42 is a drive head 44, attached such as by welding or the like. The drive head 44 includes four planar driving faces 46 formed on an exterior surface thereof. The four driving faces 46 form a substantially one-inch square drive head on the drive head 44.

The drive head 44 includes a central bore 48 therein for receiving the first end of the cable 42. The central bore 48 may extend partially through the drive head 44, as shown, or entirely therethrough. Additionally, the central bore 48 may be tapered to more securely hold the cable. The drive head 44 can also be attached to the cable by use of resin adhesives or the like. The adhesives may include metal filings or metal powder mixed therein to increase the bonding strength thereof. Additionally, the central bore 48 of the drive head 44 may be roughened to increase bond strength. Pilot holes (not shown) may extend into the central bore 48 transversely thereto. Transverse pilot holes may be used to supply additional adhesives into the central bore 48 after the cable is positioned therein. The mine roof bolt 40 additionally includes a barrel and wedge assembly adjacent the drive head 44. The barrel and wedge assembly includes a substantially tubular barrel 50 and internal locking wedges 52 which surround and securely grip onto the cable 42. The barrel and wedge assembly is a conventional, well-known and accepted mechanism for receiving the loading requirements of a mine roof bolt. In operation, the barrel 50 will be adjacent the drive head 44 and will support a bearing plate. In this embodiment, the drive head 44 is only utilized for rotating the mine roof bolt 40 during resin grouting installation. Consequently, the attachment of the drive head 44 to the cable 42 need only be sufficiently strong to receive the torque in turning of the mine roof bolt 40. The mine roof bolt 40 is specifically designed to have a minimal profile of less than about one inch beyond the barrel and wedge assembly. Consequently, the drive head 44 preferably abuts the barrel 50 to minimize this profile. The minimum profile of the mine roof bolt 40 is an important requirement in the confined spaces of a mining environment.

Figure 2:
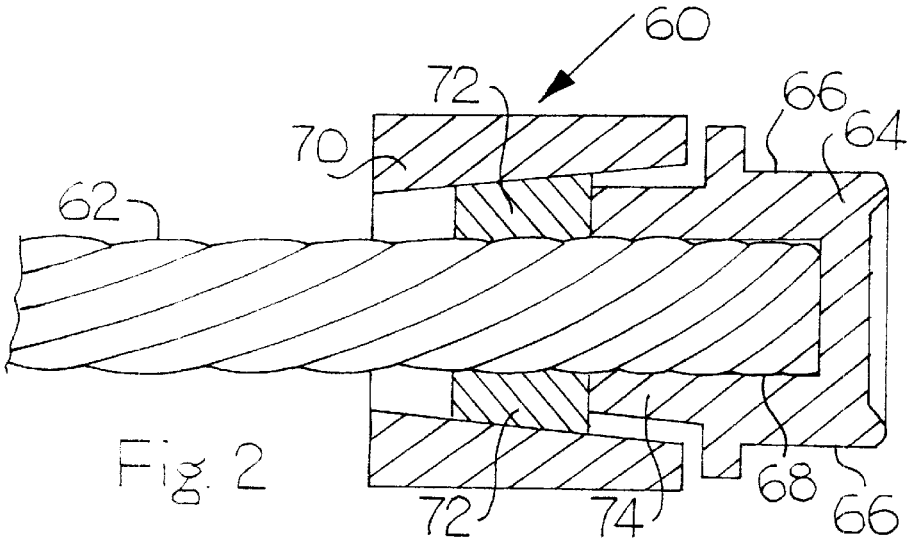
FIG. 2 is a side view, partially in section, of a second embodiment of the present invention.

FIG. 2 illustrates a mine roof bolt 60 according to a second embodiment of the present invention. The mine roof bolt 60 is substantially similar to the mine roof bolt 40 and includes a cable 62, a drive head 64 with driving faces 66 and central bore 68. A barrel and wedge assembly is provided with a barrel 70 and locking wedges 72 surrounding the cable 62. The mine roof bolt 60 differs from mine roof bolt 40 in two respects. First, the drive head 64 includes an integral sleeve member 74, which surrounds the cable 62. The sleeve member 74 allows the drive head 64 to be attached to the first end of the cable 62 by swaging, adhesives or combinations thereof. As described above, metal powder or filings may be incorporated into the adhesives, increasing the bonding strength thereof, as well as roughing of the interior of the sleeve member 74. The addition of the sleeve member 74 allows for swaging the sleeve member 74 and associated, integral drive head 64 to the cable 62. Additionally, the length of the sleeve member 74 can be selected to achieve the appropriate bonding needed between the drive head 64 and the cable 62 by adhesives and/or swaging. An increase in the length of the sleeve member 74 will correspond to an increase in the bonding strength therebetween. An additional distinction between the mine roof bolt 60 and the mine roof bolt 40 is that the locking wedges 72 have been decreased in length so that the sleeve member 74 can be received, in part, within the barrel 70. This construction minimizes the overall profile of the mine roof bolt 60 below the barrel and wedge assembly.

Figure 3:
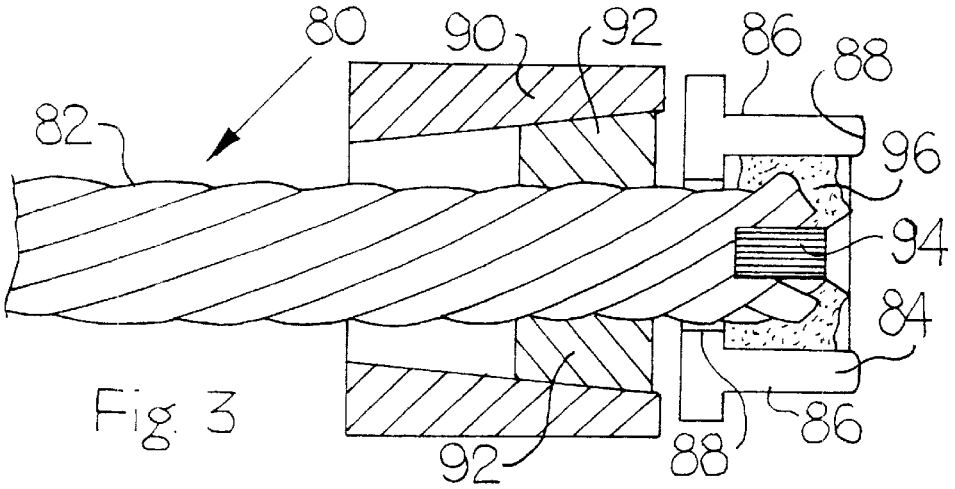
FIG. 3 is a side view, partially in section, of a third embodiment of a cable mine roof bolt according to the present invention.

FIG. 3 illustrates a mine roof bolt 80 according to a third embodiment of the present invention. The mine roof bolt 80 is substantially similar to mine roof bolts 40 and 60, as described above, and includes a cable 82, a drive head 84 with driving faces 86 and a central bore 88, and a barrel and wedge assembly comprised of barrel 90 and locking wedges 92. The mine roof bolt 80 differs from mine roof bolt 40, shown above, in that the central bore 88 extends through the drive head 84. Additionally, a cable-spreading wedge 94 is driven into the first end of the cable 82 to bias the outer peripheral strands of the cable 82 against the drive head 84 to secure the drive head 84 to the cable 82. Additionally, molten metal 96 is poured onto the outer end of the central bore 88 to further secure the cable 82 to the drive head 84. The cable-spreading wedge 94 and metal 96 may be used in conjunction with adhesives on the internal portions of the bore 88 as described above in connection with mine roof bolt 40. Additionally, the outer end of the central bore 88 may be stepped or even flared out to provide for a more secure attachment of the drive head 84. The advantage of the mine roof bolt 80, similar to the mine roof bolts 60 and 40 described above, is that the connection of the drive head 84 to the cable 82 needs only be sufficiently strong to receive the rotational forces imposed during turning. The loading requirements will be achieved by the conventional barrel and wedge assembly.

In all of the embodiments described above, the drive heads fit conventional bolting equipment without requiring additional adapters. Additionally, the drive heads are easily incorporated onto the mine roof bolt.

It will be apparent to those of ordinary skill in the art that various changes and modifications may be made to the present invention, without departing from the spirit and the scope thereof. Consequently, the scope of the present invention is intended to be defined by the attached claims and equivalents thereto.

What is claimed is:

1. A mine roof bolt comprising:

a flexible multi-strand cable having a first end and a second end;

a barrel and wedge assembly forming a load-bearing member for said mine roof bolt, said barrel and wedge assembly being directly attached to said cable between said first end and said second end; and a drive head assembly welded to said first end, said drive head assembly having a plurality of driving faces on an exterior surface thereof.

2. The mine roof bolt of claim 1 wherein said drive head assembly includes a sleeve surrounding said cable and said drive head, said sleeve being welded to said first end and said drive head having said plurality of driving faces.

3. The mine roof bolt of claim 2 wherein said sleeve is formed integrally with said drive head.

4. A mine roof bolt comprising:

a flexible multi-strand cable having a first end and a second end;

a drive head assembly welded to said first end, said drive head assembly having a plurality of driving faces on an exterior surface thereof;

a sleeve surrounding said cable, said sleeve being welded to said first end of said cable and to said drive head assembly; and a barrel and wedge assembly forming a load bearing member for said mine roof bolt, said barrel and wedge assembly being directly attached to said cable between said first end and said second end.

5. A mine roof bolt comprising:

a flexible multi-strand cable having a first end and a second end;

a drive head assembly welded to said first end, said drive head assembly having a plurality of driving faces on an exterior surface thereof;

a sleeve surrounding said cable, said sleeve being welded to said first end of said cable and integrally formed with said drive head assembly; and a barrel and wedge assembly forming a load bearing member for said mine roof bolt, said barrel and wedge assembly being directly attached to said cable between said first end and said second end.

6. A flexible mine roof bolt comprising:

a flexible multi-strand cable having at least one core strand and a plurality of peripheral strands helically wound around said at least one core strand;

a barrel and wedge assembly attached to said cable; and a drive head welded to said cable at a distal end thereof, said drive head abutting said barrel and wedge assembly, said drive head having a central bore extending therein for receiving said distal end of said cable, said drive head having a plurality of substantially planar driving faces on an exterior surface thereof.

7. A mine roof bolt comprising:

a flexible multi-strand cable having a first end and a second end;

a barrel and wedge assembly forming a load bearing member for said mine roof bolt, said barrel and wedge assembly being directly attached to said cable between said first end and said second end; and a drive head directly attached to said first end, said drive head having a plurality of driving faces on an exterior surface thereof, wherein said drive head abuts said barrel and wedge assembly.

8. The mine roof bolt of claim 7 wherein said drive head is positioned adjacent said barrel and wedge assembly wherein said drive head extends less than one inch beyond said barrel and wedge assembly.

9. The mine roof bolt of claim 7 further including a sleeve member surrounding said cable formed integrally with said drive head.

10. The mine roof bolt of claim 9 wherein said sleeve member extends partially into said barrel of said barrel and wedge assembly.

11. The mine roof bolt of claim 9 wherein said sleeve member is swaged onto said cable.

12. The wedge assembly of claim 9 wherein said sleeve member is attached to said cable by adhesives.

13. The mine roof bolt of claim 7 wherein said drive head includes a central bore which receives said cable.

14. The mine roof bolt of claim 13 wherein said bore extends longitudinally through said drive head.

15. The mine roof bolt of claim 14 further comprising a cable spreading wedge inserted into said first end of said cable with said first end of said cable positioned within said bore of said drive head, wherein said cable spreading wedge biases outer strands of said multi-strand cable against said drive head to secure said drive head to said cable.

* * * * *